US007959316B1

(12) United States Patent
Schreiber et al.

(10) Patent No.: US 7,959,316 B1
(45) **Date of Patent: *Jun. 14, 2011**

(54) METHOD AND SYSTEM FOR CREATING AN ILLUSION OF A SKYLIGHT

(75) Inventors: Radim Schreiber, Fairfield, IA (US); Skye Witherspoon, Fairfield, IA (US)

(73) Assignee: The Sky Factory, LC, Fairfield, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/342,833

(22) Filed: Dec. 23, 2008

Related U.S. Application Data

(63) Continuation of application No. 10/908,940, filed on Jun. 1, 2005, now Pat. No. 7,481,550.

(51) Int. Cl.
*F21S 8/00* (2006.01)

(52) U.S. Cl. ..... 362/148; 362/367; 362/806; 362/812; 52/28

(58) Field of Classification Search ..... 362/147–150, 362/367, 806, 812; 52/28, 200
See application file for complete search history.

(56) References Cited

U.S. PATENT DOCUMENTS

| | | | | |
|---|---|---|---|---|
| 2,772,742 | A | 12/1956 | Sprankle | |
| 4,932,170 | A * | 6/1990 | Spear | 52/28 |
| 5,426,879 | A | 6/1995 | Hecker | |
| 6,402,349 | B1 | 6/2002 | Miller et al. | |
| 7,481,550 | B1 * | 1/2009 | Schreiber et al. | 362/148 |

OTHER PUBLICATIONS

Alleged brochure of Crownlite Mfg. Corp., Bohemia, L.I., N.Y., Copyright 1982, showing "Vertical Regressed Coffer Adapter". Applicant makes no admission of prior art or the truth or accuracy of the statements made concerning the attached document.

* cited by examiner

*Primary Examiner* — Stephen F Husar
(74) *Attorney, Agent, or Firm* — Simmons Perrine Moyer Bergman PLC

(57) ABSTRACT

A system and method for creating a trompe l'oeil skylight in a T-bar type hung ceiling system where a translucent panel with an image of a sky scene is elevated above a T-bar grid, by a frame, so as to eliminate shadows of the T-bar on the image panel and so as to simulate a casement-type skylight.

20 Claims, 5 Drawing Sheets

METHOD AND SYSTEM FOR CREATING AN ILLUSION OF A SKYLIGHT

CROSS-REFERENCE TO RELATED APPLICATION

This application is a continuation of application Ser. No. 10/908,940 filed on Jun. 1, 2005, by the same inventors, with the same title as the within application.

FIELD OF THE INVENTION

The present invention generally relates to ceiling lighting systems, and more particularly relates to ceiling lighting systems with a hung grid for holding ceiling panels, and more particularly relates to methods and systems for creating an illusion of a skylight in such a hung ceiling system.

BACKGROUND OF THE INVENTION

In recent years, medical professionals have used various types of methods to calm a patient who is undergoing or waiting for an important medical procedure. One example is the use of a skylight so the patient can have a view of the outdoors. While this is often very effective at helping to pacify a nervous patient, it is often not practical, especially in interior spaces without roof exposure or in shielded spaces used for radiological imaging or diagnostic equipment which often is required to be in completely enclosed and controlled areas. Other examples of needs for creating an illusion of a skylight exist as well.

One prior art method of pacifying a patient has been to create a trompe l'oeil skylight by using translucent panels of an image of the sky and deploying them as a diffuser panel of the type typically placed in the grid below a fluorescent lamp used in a hung ceiling.

Such systems have been used extensively in the past and have positive characteristics, such as the ability to easily remove the translucent panel so as to allow for replacement of backlight lamps, etc. and the ability to eliminate the need for a drop-down door and the concomitant increase in mullion width that is caused by use of drop-down doors. These prior art systems do have several drawbacks. While they do tend to create a more pleasant environment, they often fail to trick the eye into believing it is a real skylight, and they often exhibit unwanted shadows created by the T-bar in the hung ceiling grid.

Consequently, there exists a need for improved methods and systems for creating an illusion of a skylight in a hung panel-type ceiling.

SUMMARY OF THE INVENTION

It is an object of the present invention to provide, in a cost-efficient manner, a system and method for creating an illusion of a skylight in a hung panel type ceiling.

It is a feature of the present invention to utilize an elevator frame configured to raise a translucent panel above the typical T-bar of a hung ceiling.

It is another feature of the present invention to provide an elevator frame which creates an illusion of a typical frame in a casement window or skylight.

It is an advantage of the present invention to achieve improved realism in the illumination of the panel in that shadows cast by the T-bar are eliminated.

It is another advantage of the present invention to provide the illusion of a casement-type window frame.

It is another advantage of the present invention to provide for the ability to easily and cost efficiently implement a trompe l'oeil skylight in a hung ceiling system where the trompe l'oeil skylight appears to be made of a different material than the ceiling grid.

The present invention is an apparatus and method for providing a trompe l'oeil skylight which is designed to satisfy the aforementioned needs, provide the previously stated objects, include the above-listed features, and achieve the already articulated advantages. The present invention is carried out in a "T-bar shadow-less" manner in a sense that the shadows cast on a translucent image panel by T-bar ceiling grid members, have been eliminated. The invention is also accomplished in "trompe l'oeil" manner in the sense that the appearance of the elevator frame in combination with the lower grid member tricks the eye of the observer into believing it is a casement-type skylight.

Accordingly, the present invention is a system and method including an elevator frame having a protuberance thereon for restricting horizontal movement of a translucent image panel while it is resting on the elevator frame which is being supported by a T-bar grid system of a hung ceiling.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
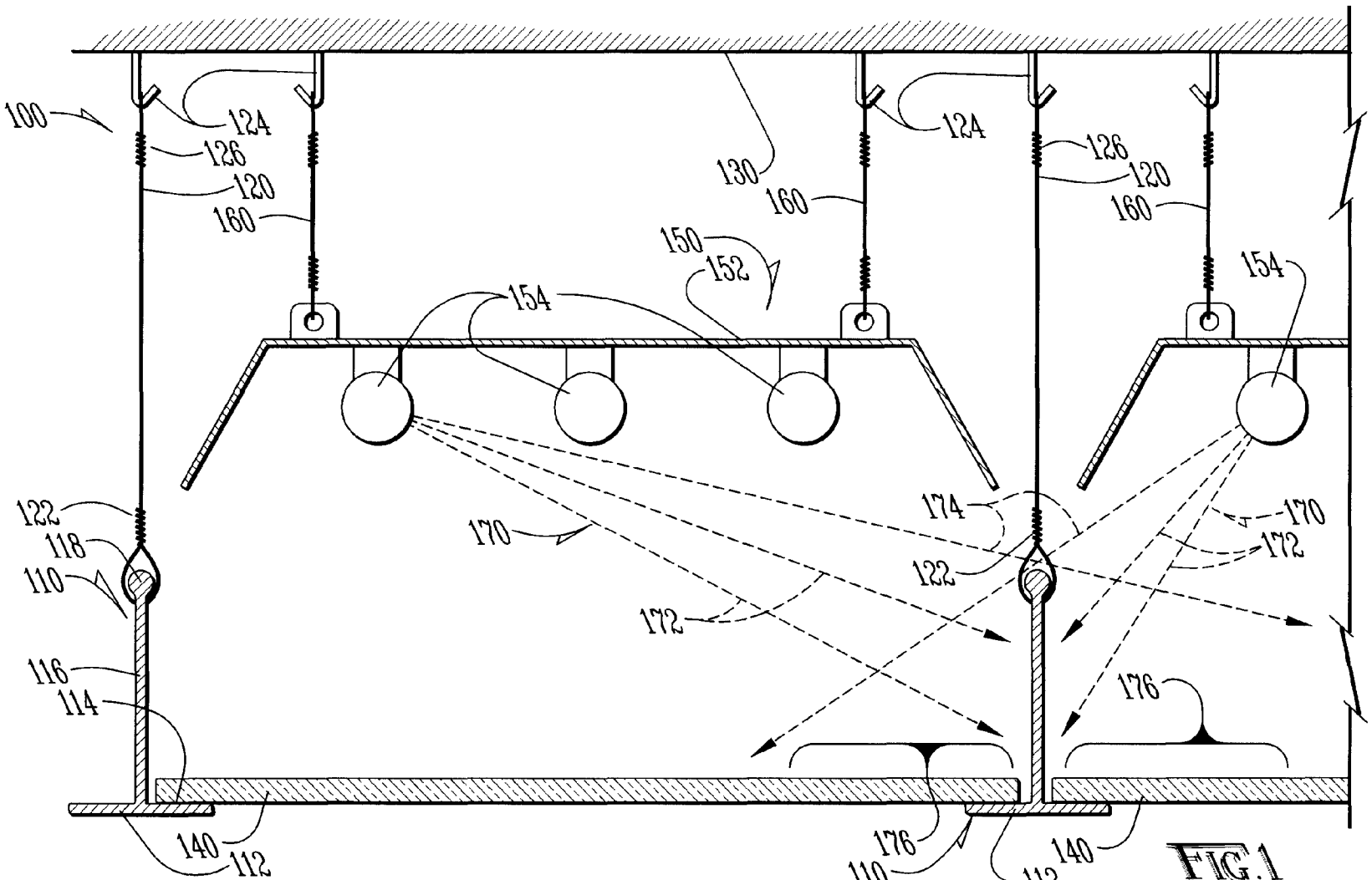
FIG. 1 PRIOR ART
FIG. 1 is an elevation or side view of a prior art hung ceiling system with an illuminated panel.

Now referring to the drawings wherein like numerals refer to like matter throughout, and more specifically referring to FIG. 1, there is shown a side view of a hung ceiling system of the prior art generally designated 100 which includes a translucent sky image panel 140. This end view or cross-sectional view is of a translucent sky image panel disposed with a T-bar grid member 110 on each side. The T-bar grid member 110 is a long linear T-shaped element which has a T-bar grid member bottom surface 112 which is visible to the consumer along with other translucent sky image panels 140 and other ceiling tiles (not shown). T-bar grid member 110 has a T-bar grid member bottom shelf 114 where the translucent sky image panel 140 or a regular ceiling tile would rest. T-bar grid member 110 has a T-bar grid member vertical member 116 and a T-bar grid member top portion 118 which is coupled to a T-bar suspension wire 120 by a T-bar suspension wire bottom winding 122. T-bar suspension wire 120 is often attached at intervals larger than the length of the ceiling tiles and the translucent sky image panel 140. T-bar suspension wire 120 is shown coupled to a hidden ceiling coupling device 124 by a T-bar suspension wire top winding 126. Variations of this prior art system are well known in the art. The translucent sky image panel 140 is backlit by a backlight fixture 150 having a reflector 152 and a group of backlight lamps 154. Backlight fixture 150 is hung from the hidden ceiling 130 via backlight fixture suspension wires 160 in a well-known manner. One common detail of this system is that a gap exists between the numerous T-bar grid members 110 and the bottom of the reflector 152. This allows a panel to be inserted in a space above the T-bar grid member 110 and then manipulated and then let back down onto the T-bar grid member bottom shelf 114.

Backlight fixture 150 emits light in many directions; however, only a portion of the light rays emanating from the backlight lamps 154 are shown. Selected light rays 170 are shown to be directed generally toward a T-bar grid member 110. It can be seen that blocked light rays 172 are unable to reach a translucent sky image panel 140 in an adjacent section because of the optical barrier created by the presence of T-bar grid member 110. Non-blocked inter-panel light rays 174 is shown to depict light from one section of a ceiling which tends to provide part of the illumination of a translucent sky image panel 140 which is not directly below the source of the non-blocked inter-panel light rays 174. A partially shaded region 176 area occurs if the T-bar grid member 110 blocks the blocked light rays 172. These partially shaded regions 176 are on both sides of the T-bar grid member 110. T-bar grid members 110, which are perpendicular to the two T-bar grid members 110 shown, also are used to support translucent sky image panels 140 and other ceiling tiles. These perpendicular grid components also tend to make partially shaded areas as well.

Figure 2:
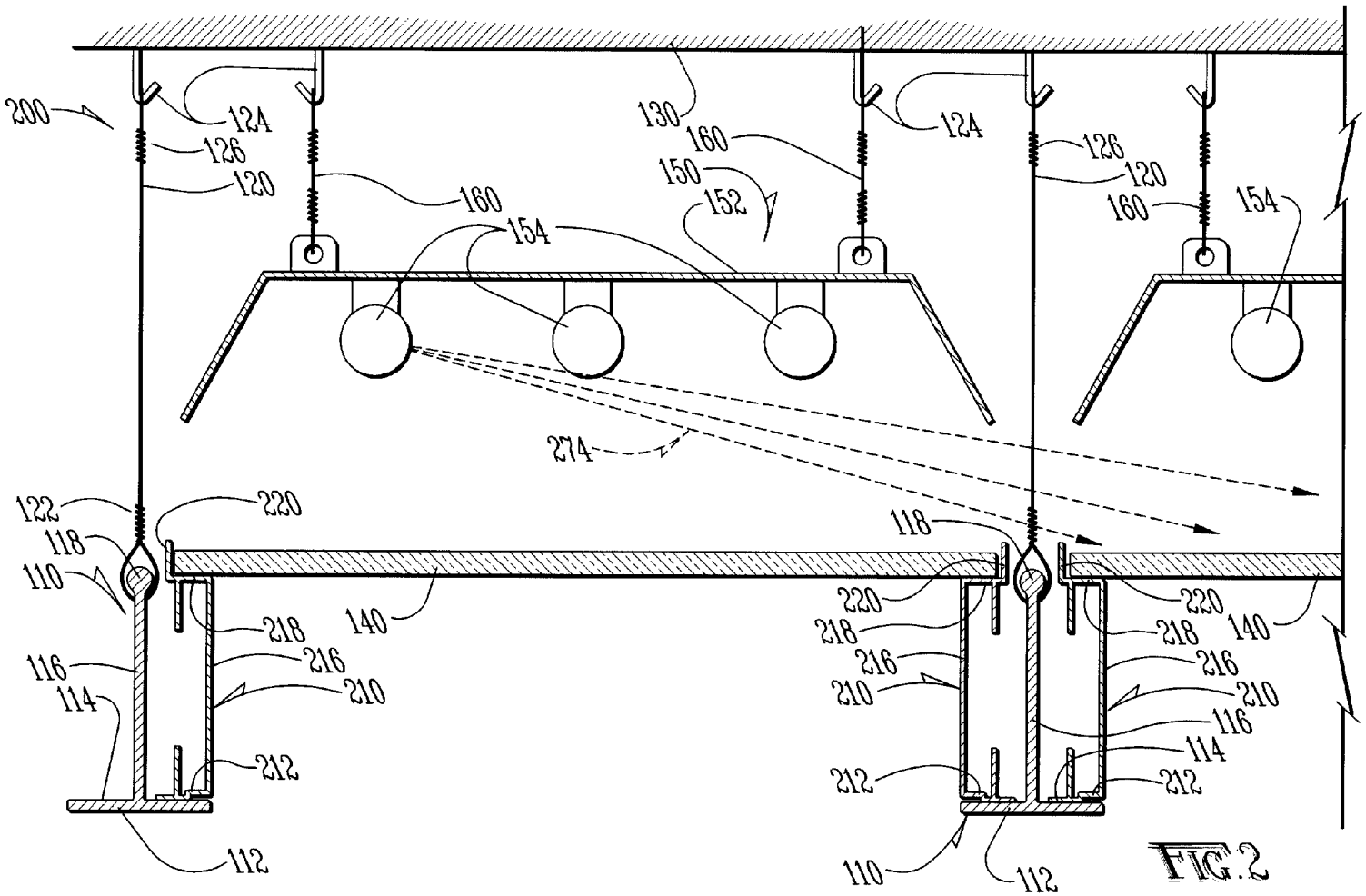
FIG. 2 is a side or elevation view of the system of the present invention which includes a panel elevating frame disposed within a prior art hung ceiling system grid.

Now referring to FIG. 2, there is shown a side view of the hung ceiling system of the present invention generally designated 200, which includes the panel elevating frame 210, which raises the translucent sky image panel 140 above the T-bar grid member 110. Panel elevating frame 210 may be made of a material similar to T-bar grid member 110, or it may be made of other suitable materials as well. Often lightweight materials, such as aluminum, are preferred. In some embodiments of the present invention, panel elevating frame 210 may be made of wood and a trim piece of a matching wood is placed over the T-bar grid member bottom surface 112, thereby creating an illusion of a wood casement window frame. Panel elevating frame 210 is shown having a panel elevating frame bottom surface 212 which rests upon T-bar grid member bottom shelf 114. Panel elevating frame 210 has a visible interior surface panel elevating frame vertical section 216 and a panel elevating frame top shelf 218 which is not visible from underneath by a typical viewer. Panel elevating frame top shelf 218 has a panel elevating frame slide limiting protuberance 220 disposed thereon to help limit the amount of sliding that can occur between translucent sky image panel 140 and the panel elevating frame top shelf 218. The distance between two panel elevating frame slide limiting protuberances 220 on opposing sides of a single translucent sky image panel 140 is greater than the width of the translucent sky image panel 140, while the distance between two panel elevating frame vertical sections 216 on opposing sides of the translucent sky image panel 140 is less than the width of the translucent sky image panel 140. Panel elevating frame 210 is preferably a rectangular frame which rests on the T-bar grid member bottom shelf 114 of the various T-bar grid members 110 which surround a translucent sky image panel 140 when it is in place in the ceiling. The perpendicular sections of panel elevating frame 210 are not shown in the FIG. 2.

Backlight lamps 154 are shown having light rays 274 which illuminate an adjacent panel and are not blocked by the T-bar grid member 110. The T-bar suspension wire 120 can cause some minor shadowing, but since the thickness of a T-bar suspension wire 120 is much smaller than the length of a T-bar grid member 110, the amount of shading at the edge of a translucent sky image panel 140 caused by the T-bar suspension wires 120 is insignificant in comparison to the amount of edge shading that results from a T-bar grid member 110 when it is used without the panel elevating frame 210 of the present invention.

Figure 3:
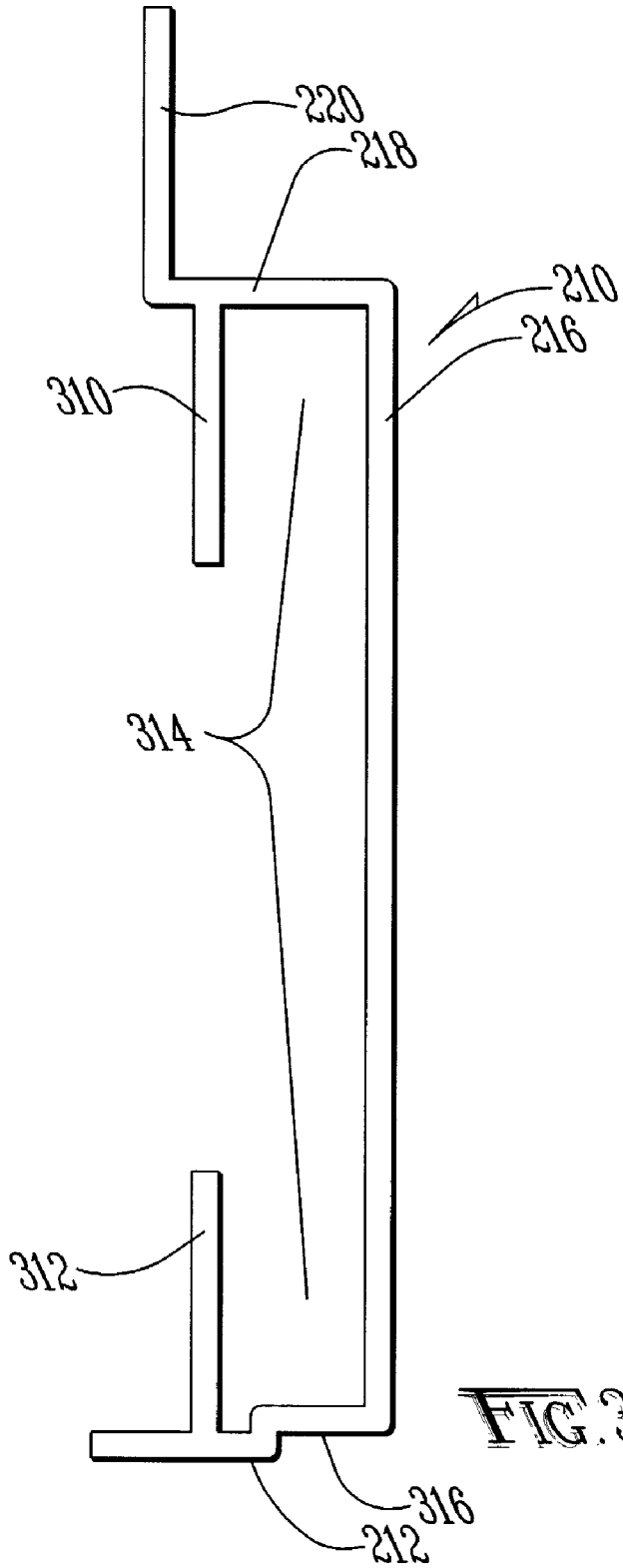
FIG. 3 is a close cross-sectional view of one side of the panel elevating frame of the present invention.

A more detailed understanding of the present invention can be achieved by now referring to FIG. 3, which shows a cross-sectional view of one piece of the panel elevating frame 210 which shows the visible inside surface panel elevating frame vertical section 216 and top angled corner piece retaining member 310 and bottom angled corner piece retaining member 312. Angle corner piece receiving gap 314 is the gap between the top angled corner piece retaining member 310 and the non-visible side of panel elevating frame vertical section 216 and the gap between bottom-angled corner piece retaining member 312 and the non-visible side of panel elevating frame vertical section 216. Panel elevating frame 210 may be an extruded aluminum piece and top-angled corner piece retaining member 310 and bottom-angled corner piece retaining member 312 may be merely sections of an elongated section of panel elevating frame 210. The angle corner piece receiving gap 314 is made to secure with a friction fit an angled corner piece 410 of FIG. 4. There is shown a bottom inside recess 316 which is provided for accommodation of the extra thickness of the rolled back grid edge of standard ceiling grid.

Figure 4:
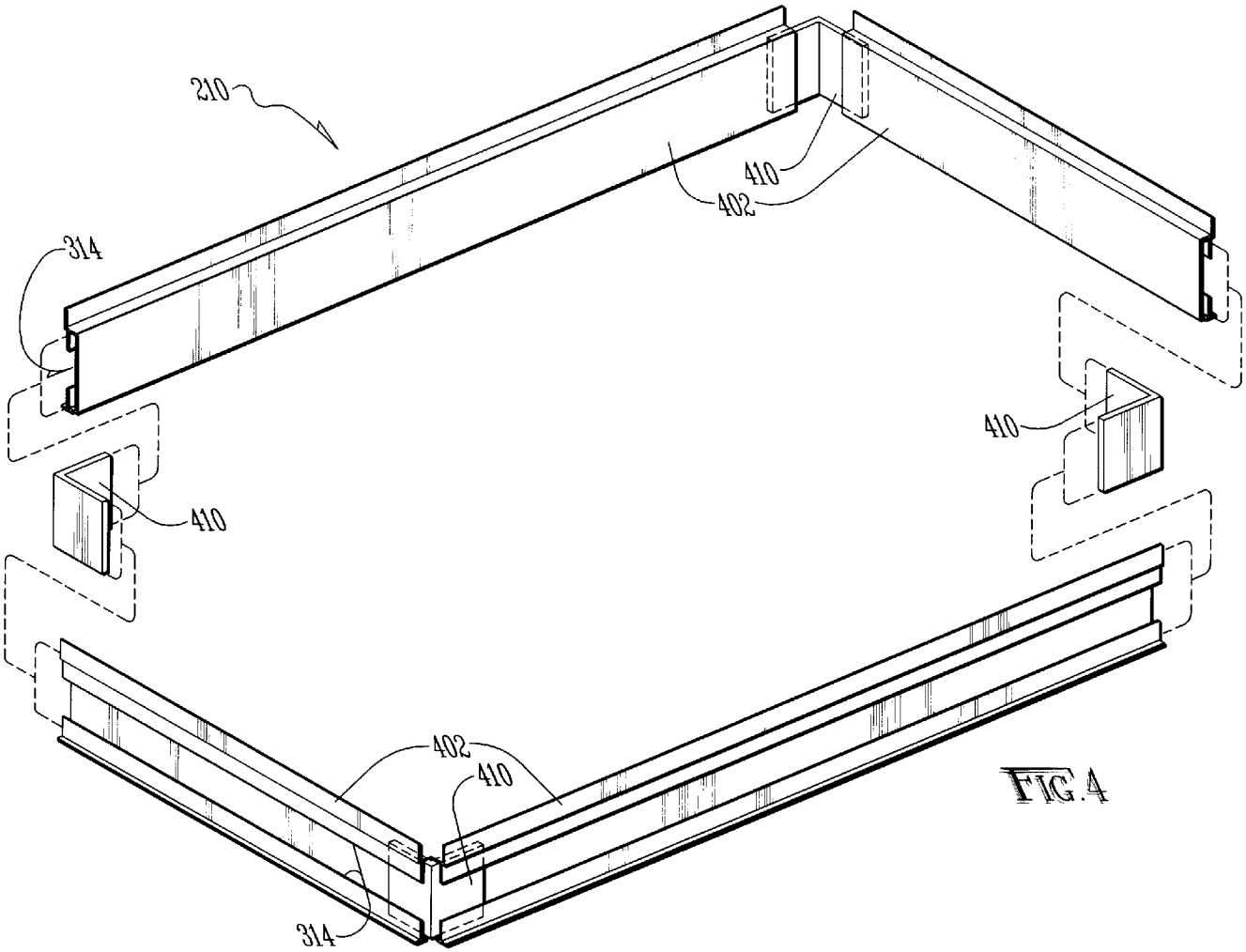
FIG. 4 is an exploded view of a panel elevating frame of the present invention.
Figure 5:
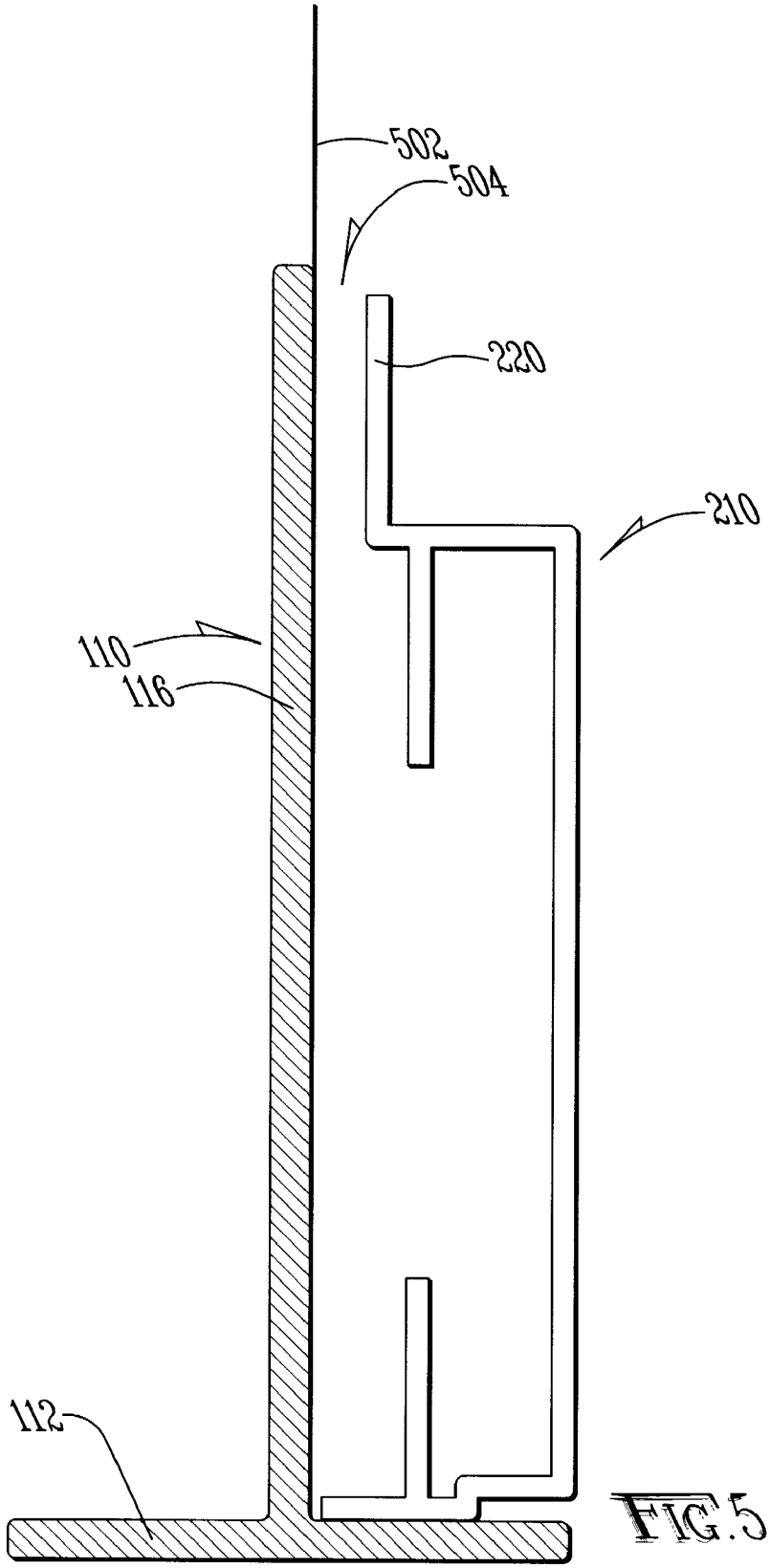
FIG. 5 is an additional side view of the panel elevating frame of the present invention where an end cap of a light box is disposed between the panel elevating frame and the T-bar grid member.

An even more detailed understanding of the present invention may be achieved by now referring to FIG. 4, which shows an exploded view of the panel elevating frame 210 of the present invention with four individual sections 402 of the panel elevating frame 210. Each section 402 is coupled at each end to two other sections 402 by angled corner pieces 410. The angled corner pieces 410 are an aluminum material which is capable of retaining the preferably rectangular shape and are inserted into the angle corner piece receiving gap 314 in the end of each section 402 as shown, thereby creating a rectangular panel elevating frame 210. In the case of a wood system, various traditional methods of joining corners to insure a rigid 90-degree corner can be used Now referring to FIG. 5, there is shown a T-bar grid member 110 with a panel elevating frame 210 disposed thereon. Panel elevating frame 210 is shown separated from T-bar grid member vertical member 116 by an end cap wall receiving gap 504 with an end cap wall 502 disposed therein. The present invention can thereby accommodate backlight fixtures which utilize end caps to help provide support and help alignment of the backlight fixture with respect to the grid system.

Throughout this description, reference is made to "translucent sky panel" or a "translucent sky image panel". It should be understood that this could refer to any type of panel which is made to create an appearance as if looking out a skylight up to the sky. These panels can include images of items other than clouds. They can include images of trees or other items which might help create an illusion of looking up through a skylight to the outdoors. The present invention is intended to cover all such items.

Throughout this description, reference is made to a patient. The present invention is intended to apply to any person for whom it is desirable to have a trompe l'oeil skylight.

The term "trompe l'oeil" is used herein to mean simulated so as to trick the eye.

The present invention is described in a preferred embodiment as being rectangular because it is believed that a rectangular ceiling grid is the most efficient. However, other shapes, including circular and oval, can be used as well.

While the description of the present invention herein has been largely focused upon, or otherwise assuming, the use of a standardized (2'×2' or 2'×4') grid system with translucent panels, it should be understood that the elevator concept of the present invention, with its ability to imitate the look of a group of skylights, could be employed with non-standardized grids and with panels other than translucent panels. In fact, the present invention could be implemented with custom-sized panels and with flat panel electronic displays, such as flat liquid crystal displays (LCDs), plasma displays, and other types of electronic video-type displays. In such cases, the group of several flat panel displays would be synchronized so as to appear to be one large image located behind a group of skylights, where the illusion of skylights is created by the innovative elevator element as used in the present invention to create an illusion of a group of skylights disposed above a normal hung ceiling.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A method of simulating a skylight by illuminating a substantially rectangular translucent panel in a hung ceiling of the type designed for supporting a plurality of substantially rectangular ceiling tiles comprising the steps of:

providing a ceiling with a plurality of substantially rectangular voids configured to receive therein substantially uniformly dimensioned ceiling tiles of a predetermined tile size which is slightly larger than said plurality of substantially rectangular voids;

wherein said ceiling comprises a plurality of "T" shaped bars, each of which has a top central portion;

disposing in a substantially rectangular void in said ceiling a substantially rectangular panel elevating frame which has an exterior size which is sized larger than each of said plurality of substantially rectangular voids, and has a predetermined interior frame size;

disposing adjacent said substantially rectangular panel elevating frame a substantially rectangular translucent panel which is sized slightly larger than said predetermined interior frame size;

wherein said substantially rectangular translucent panel is inset into said ceiling by said substantially rectangular panel elevating frame;

wherein said substantially rectangular translucent panel exhibits a sky image; and providing artificial backlighting of a backlit side of said substantially rectangular translucent panel.

2. A method of simulating a skylight in a ceiling comprising the steps of:

providing a planar support structure;

providing a ceiling with a first void therein; disposed below said planar support structure such that said first void is not in registration with a second void which is located in said planar support structure;

disposing in said first void a panel elevating frame which has a planar bottom side with an exterior size which is sized larger than said first void, and has a predetermined interior frame size;

disposing adjacent said panel elevating frame a light emitting panel which is sized slightly larger than said predetermined interior frame size; and wherein said light emitting panel is inset into said ceiling by said panel elevating frame and exhibits a sky image.

3. A method of claim 2 wherein said first void is circular.

4. A method of claim 2 further comprising the steps of:

backlighting a backlit side of a substantially rectangular translucent panel.

5. A method of claim 4 wherein said substantially rectangular translucent panel comprises a liquid crystal display which produces a non-static non-homogenous image.

6. A method of claim 2 wherein said light emitting panel comprises a liquid crystal display which produces a video display.

7. A method of simulating a skylight in a ceiling comprising the steps of:

providing a planar support structure;

providing a ceiling with a ceiling first void therein; disposed below said planar support structure such that said ceiling first void is not in registration with a second void which is located in said planar support structure;

disposing in a said first void in said ceiling a panel elevating frame which has an exterior size which is sized larger than said first void, and has a predetermined interior frame size;

disposing adjacent said panel elevating frame a light emitting panel which is sized slightly larger than said predetermined interior frame size; and wherein said light emitting panel is inset into said ceiling by said panel elevating frame; and further comprising a non-homogenous translucent static image of a sky.

8. A method of simulating a skylight in a ceiling comprising the steps of:

providing a planar support structure;

providing a ceiling with a ceiling first void therein; disposed below said planar support structure such that said ceiling first void is not in registration with a second void which is located in said planar support structure;

disposing in a said first void in said ceiling a panel elevating frame which has an exterior size which is sized larger than said first void, and has a predetermined interior frame size;

disposing adjacent said panel elevating frame a light emitting panel which is sized slightly larger than said predetermined interior frame size;

wherein said light emitting panel is inset into said ceiling by said panel elevating frame;

backlighting a backlit side of a substantially rectangular translucent panel; and wherein said substantially rectangular translucent panel comprises a liquid crystal display which produces a static non-homogenous translucent image of a sky.

9. A method of simulating a skylight in a ceiling comprising the steps of:

providing a ceiling with a void;

disposing in said void in said ceiling a panel elevating frame which has a planar bottom side with an exterior size which is not sized substantially larger than said void, and has a predetermined interior frame size;

disposing adjacent to said panel elevating frame a light emitting panel which is not sized substantially larger than said predetermined interior frame size;

emitting only artificial light through said light emitting panel; and wherein said light emitting panel is inset into said ceiling by said panel elevating frame and exhibits a sky image.

10. The method of claim 9 wherein said light emitting panel is a translucent panel.

11. The method of claim 9 wherein said void is substantially rectangular.

12. The method of claim 9 wherein said void is square.

13. The method of claim 9 wherein said light emitting panel comprises a light-emitting diode.

14. The method of claim 9 wherein said void is circular.

15. A method of simulating a skylight in a ceiling comprising the steps of:

providing a ceiling with a void;

disposing in said void in said ceiling a panel elevating frame which has an exterior size which is not sized substantially larger than said void, and has a predetermined interior frame size;

disposing adjacent to said panel elevating frame a light emitting panel which is not sized substantially larger than said predetermined interior frame size;

emitting only artificial light through said light emitting panel;

wherein said light emitting panel is inset into said ceiling by said panel elevating frame; and wherein said light emitting panel comprises a plasma screen.

16. The method of claim 15 further comprising the steps of:

providing a planar support structure;

disposing said ceiling below said planar support structure such that said void is disposed below a continuous portion of said planar support structure.

17. A method of simulating a skylight in a ceiling comprising the steps of:

providing a ceiling with a void;

disposing in said void in said ceiling a panel elevating frame which has an exterior size which is not sized substantially larger than said void, and has a predetermined interior frame size;

disposing adjacent to said panel elevating frame a light emitting panel which is not sized substantially larger than said predetermined interior frame size;

emitting only artificial light through said light emitting panel; and wherein said light emitting panel is inset into said ceiling by said panel elevating frame;

wherein said light emitting panel has an image thereon in which said image comprises a sky scene.

18. A method of simulating a skylight by illuminating a substantially rectangular translucent panel in a hung ceiling of the type designed for supporting a plurality of substantially rectangular ceiling tiles comprising the steps of:

providing a ceiling with a plurality of substantially rectangular voids configured to receive therein substantially uniformly dimensioned ceiling tiles of a predetermined tile size which is slightly larger than said plurality of substantially rectangular voids;

wherein said ceiling comprises a plurality of "T" shaped bars, each of which has a top central portion;

disposing in a substantially rectangular void in said ceiling a substantially rectangular panel elevating frame which has an exterior size which is sized larger than each of said plurality of substantially rectangular voids, and has a predetermined interior frame size;

disposing adjacent said substantially rectangular panel elevating frame a substantially rectangular light emitting panel which is not sized substantially larger than said predetermined interior frame size;

wherein said substantially rectangular light emitting panel is inset into said ceiling by said substantially rectangular panel elevating frame and emits only artificial light; and wherein said substantially rectangular light emitting panel exhibits a sky image.

19. A method of claim 18 wherein said light emitting panel is a backlit translucent panel comprising a liquid crystal display.

20. A method of claim 18 wherein said substantially rectangular light emitting panel is a plasma screen.

* * * * *